United States Patent [19]

Ogihara et al.

[11] 4,351,043

[45] Sep. 21, 1982

[54] TIME DETECTING SWITCH FOR AN ALARM CLOCK

[75] Inventors: Masuo Ogihara; Kozo Chimura; Nobuo Shinozaki, all of Yotsukaido, Japan

[73] Assignee: Seiko Koki Kabushiki Kaisha, Japan

[21] Appl. No.: 196,292

[22] Filed: Oct. 14, 1980

Related U.S. Application Data

[63] Continuation of Ser. No. 908,560, May 22, 1978, abandoned.

[30] Foreign Application Priority Data

May 26, 1977 [JP] Japan ..... 52-67946[U]

[51] Int. Cl.[3] ..... G04C 21/16

[52] U.S. Cl. ..... 368/252

[58] Field of Search ..... 368/72–74, 368/109, 243, 244, 250, 252, 254, 269

[56] References Cited

U.S. PATENT DOCUMENTS

| | | | |
|---|---|---|---|
| 3,313,100 | 4/1967 | Schuab | 368/250 |
| 3,686,879 | 8/1975 | Hummel et al. | 368/252 |
| 3,996,734 | 12/1976 | Kitai et al. | 368/250 |
| 4,015,417 | 4/1977 | Kitai et al. | 368/249 |
| 4,045,627 | 8/1977 | Kitai et al. | 368/250 |
| 4,070,822 | 1/1978 | Akai | 368/282 |
| 4,079,551 | 3/1978 | Kitai et al. | 368/263 |

*Primary Examiner*—Vit W. Miska

*Attorney, Agent, or Firm*—Robert E. Burns; Emmanuel J. Lobato; Bruce L. Adams

[57] ABSTRACT

An alarm clock comprises at least one rotationally driven rotatable time wheel, at least one rotatable detecting wheel rotatable relative to the time wheel to phases corresponding to alarm signaling times by an alarm signaling time setting wheel, and a time detecting switch having an open switching state when the time wheel is out of phase with the detecting wheel and switchable to a closed switching state when the time wheel rotates into phase with the detecting wheel to thereby enable the sounding of an alarm at preselected alarm signaling times. The time detecting switch comprises a slide switch comprising one of the time and detecting wheels being comprised of a one-piece structure composed of electrically conductive material and having a gear teeth portion for meshing with another gear and having a first set of projections which define the contact points of the slide switch, and the other of the time and detecting wheels being composed of electrically insulating material and having a switch plate connected thereto having a contact portion for making sliding electrical contact with the first set of projections.

5 Claims, 5 Drawing Figures

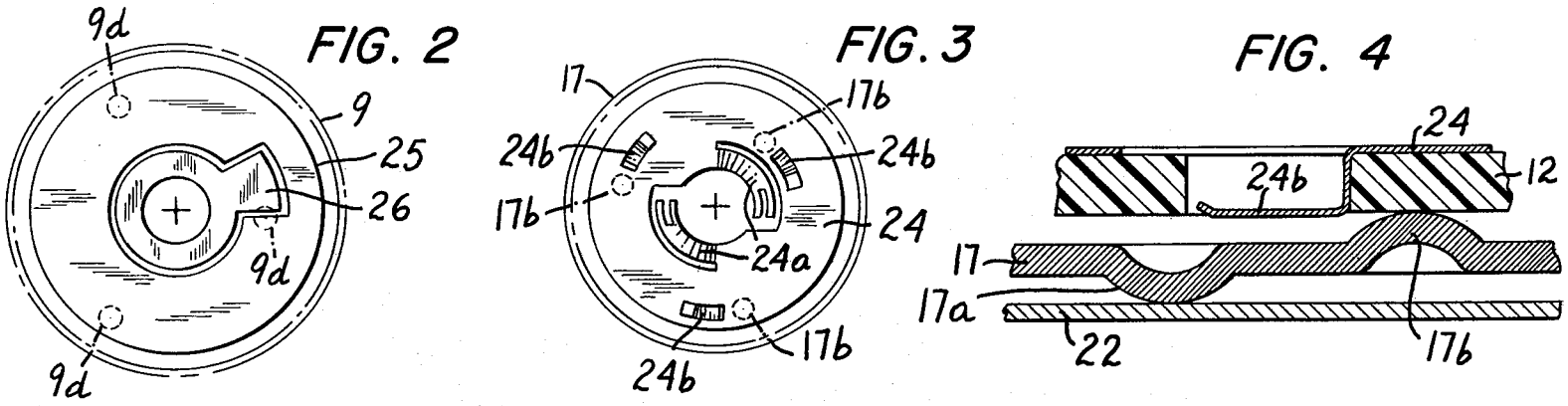
FIG. 4
FIG. 3
FIG. 2
12
24
24b
17b
22
17
17a
24a
9
25
26
9d
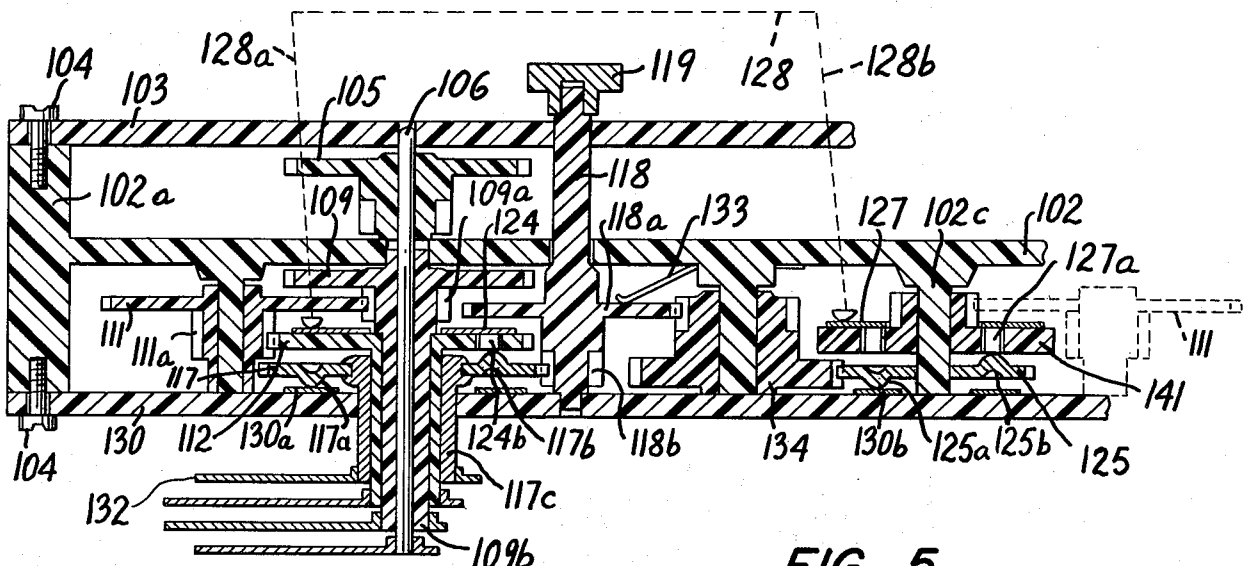
FIG. 5
111
141
125
125b
125a
127a
102
102c
127
130b
134
128b
128
133
118a
118b
119
118
117b
124b
117c
109b
109a
124
106
105
109
117a
130a
128a
112
117
111a
111
130
132
103
102a
104

TIME DETECTING SWITCH FOR AN ALARM CLOCK

This is a continuation, of application Ser. No. 908,560, filed May 22, 1978, now abandoned.

BACKGROUND OF THE INVENTION

This invention relates to a time detecting switch device for an alarm clock to actuate an electric alarm signaling device at a present alarm signaling time.

The essential mechanism of the conventional detecting device for an alarm clock is a drop-in type mechanism constituted of holes and projections provided for time wheels and corresponding detecting wheels, respectively. This mechanism has a disadvantage that, in setting the alarm signaling time or in adjusting time indication, the corresponding setting knob or adjusting knob can be rotated in only one direction because the wall of the hole and the side face of the projection are shaped vertically straight with each other so as to make the projection drop in the hole instantaneously to attain accurate alarm signaling time detection. Further disadvantage of this conventional mechanism is that the electromechanical transducer is undesirably loaded when the projection escapes out of the hole along the inclined wall of the hole with rotation of the wheels.

In order to overcome those disadvantages, the detecting device according to this invention is provided with a phase detecting type slide contact switch which is more simple in fabrication and less costly.

The object of the invention is attained by constituting phase detecting type slide contact switches with the detecting wheels and the time wheels, either the detecting wheels or the time wheels are made of electric conductive material having projections which are the part of contact means of the slide contact switches.

BRIEF DESCRIPTION OF THE DRAWINGS

FIGS. 2 and 3 are partial plan view of the device shown in FIG. 1.

FIG. 4 is a partial plan view of the device shown in FIG. 3.

FIG. 5 is a sectional view of the second embodiment of this invention.

Referring to FIGS. 1 to 4 inclusive, explanation will be made on the first embodiment.

Figure 1:
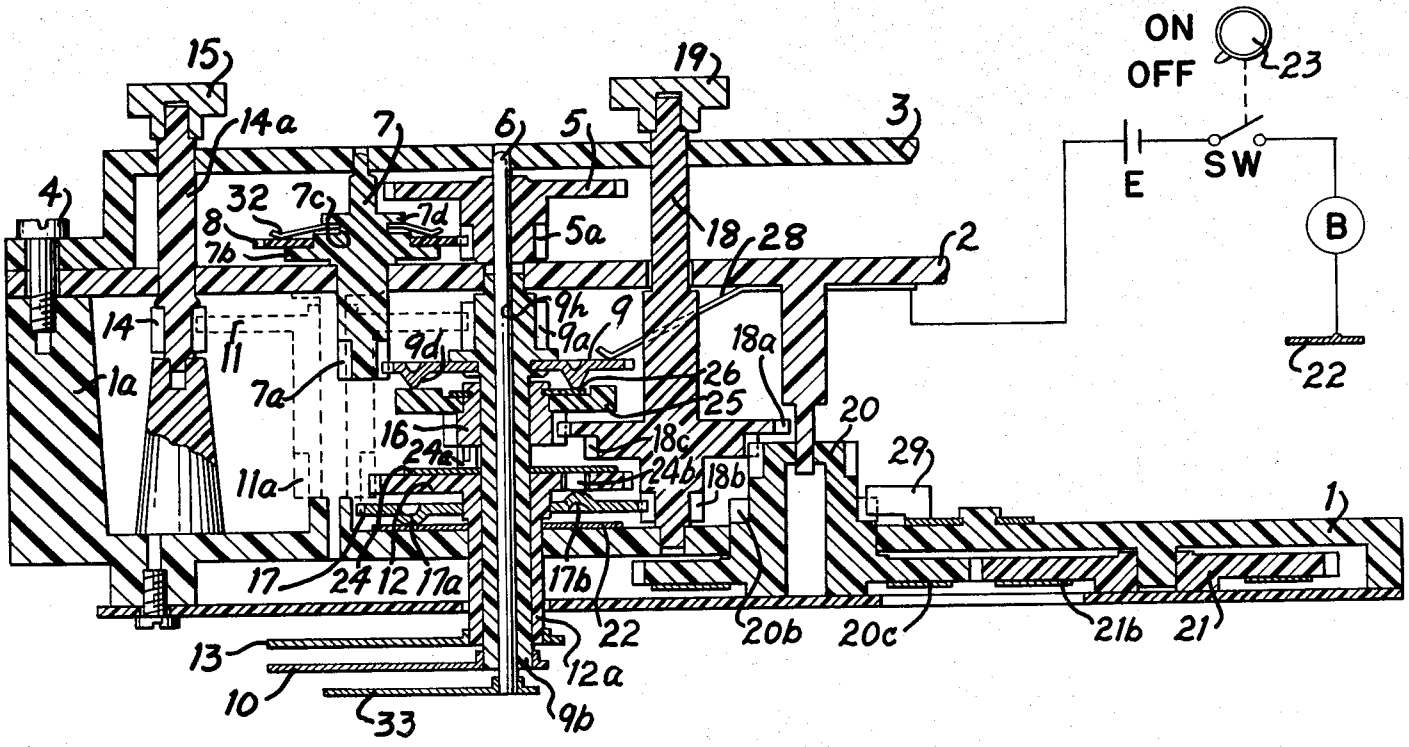
FIG. 1 is a sectional plan view of the first embodiment of this invention.

A case (1) made of plastics has a projection (1*a*) at its left end and holes to rotatably guide an hour wheel (12), an alarm signaling time setting wheel (18) and a time indication adjusting wheel (14).

A middle frame (2) made of plastics has holes to rotatably guide an intermediate spindle (7), a minute wheel (9), the alarm signaling time setting wheel (18), the time indicating adjusting wheel (14) and an intermediate hour wheel (11).

A cover (3) made of plastics has holes to rotatably guide a spindle (6) of a second wheel (5), the intermediate spindle (7), the time indication adjusting wheel (14) and the alarm signaling time setting wheel (18).

The middle frame (2) and the cover (3) are assembled to the case (1) and fastened at the projection (1*a*) by means of a screw (4).

Following explanation is concerned with a gear train for the time indicating mechanism.

A pinion (5*a*) and the second wheel (5) formed in a body are fixed to the spindle (6) extending through the tubular boss (9*h*) of the minute wheel (9). The second hand (33) is fixed to the spindle (9) at its projecting end. The second wheel (5) is driven by a motor, for instance a step motor, not shown.

The intermediate spindle (7), a pinion (7*a*), a first flange (7*b*), a groove (7*c*) and a second flange (7*d*) are made of plastics in a body.

An intermediate wheel (8) engaging with the pinion (5*a*) is rotatably fitted on the first flange (7*b*) and pressed against the first flange (7*b*) by a leaf spring (32) retained by the groove (7*c*) so that the intermediate wheel (8) and the spindle (7) are frictionally coupled. The minute wheel (9) engaging with the pinion (7*a*) is made of electric conductive material and fixed to the tubular boss (9*b*) of the pinion (9*a* ). The tubular boss (9*b*) extends through the hour wheel (12) and provided with the minute hand (10) at its end.

The intermediate hour wheel (11) engaging with the pinion (9*a*) and the pinion (11*a*) are formed in a body. The hour wheel (12) engaging with the pinion (11*a*) and its tubular boss (12*a*) are made of plastics in a body. The hour hand (13) is fixed to the end of the tubular boss (12*a*). The time indication adjusting wheel (14) also is engaged with the intermediate hour wheel (11). The shaft (14*a*) of the time indication adjusting wheel (14) projects through the cover (3) and fixedly provided with a knob (15) at the end.

Following explanation is concerned with a gear train for the alarm signaling mechanism.

A minute detecting wheel (16) made of electric conductive material is rotatably fitted on the tubular boss (9*b*) between the minute wheel (9) and the hour wheel (12). An hour wheel (17) made of electric conductive material is rotatably fitted on the tubular boss (12*a*).

An alarm signaling time setting wheel (18) of a compound wheel made of plastics is constituted in a body of a first wheel (18*a*) engaging with the minute detecting wheel (16), a second wheel (18*b*) engaging with the hour detecting wheel (17) and a third wheel (18*c*).

A knob (19) is fixed to the alarm signaling time setting wheel (18) at an end. A minute alarm signaling time indicating wheel (20) engaging with the third wheel (18*c*) is provided with a place advancing teeth for intermittently driving an hour alarm signaling time indicating wheel (21), a click-stop wheel (20*b*) engaging with a click-stop spring (29) fixed to the case (1) and minute marks (20*c*) such as 0, 5, . . . 55, on its front surface. The hour alarm signaling time indicating wheel (21) is provided with a gear engaging with the place advancing teeth of the minute signaling time indicating wheel (20) and hour marks (21*b*), such as 1, 2, . . . 12, on its front surface.

The alarm signaling mechanism is set at an optional time by turning the knob (19) observing time indication by the alarm signaling time marks (20*c*) and (21*b*).

Following explanation is concerned with a switching mechanism for detecting the alarm signaling time.

One terminal of a buzzer (B) is connected to the negative terminal of a battery (E) through a medium of a manual switch (SW) operated by an alarm signaling setting knob (23) while the other terminal is connected to a first stationary contact plate (22). The hour detecting wheel (17) has on its bottom face three first projections (17*a*) disposed on the same circle at equal angular intervals and on its upper face three second projections (17*b*) disposed on different circles at equal angular intervals as shown in FIG. 3 by dotted line.

The hour detecting wheel (17) and the first stationary contact plate (22) are always electrically connected by the contact of the first projections (17*a*) with the stationary contact plate (22).

An hour switch plate (24) fixed on the hour wheel (12) has raised slide contact pieces (24*a*) and slide contact pieces (24*b*) extending downwardly penetrating the hour wheel (12) as shown in FIG. 4 and disposed on different circles at equal angular intervals as shown in FIG. 3. The contact of the slide contact pieces (24*b*) are almost in the plane of bottom face of the hour wheel (12). Normally, the hour wheel (12) and the hour detecting wheel (17) are electrically disconnected as the second projections (17*b*) of the hour detecting wheel (17) are in contact with bottom face of the hour wheel (12) and are electrically connected once every twelve hours when the second projections (17*b*) have come in contact with the corresponding slide contact pieces (24*b*).

Additional explanation will be made on the construction of the switch.

Generally, either of the contact pieces, integral parts of a slide switch, is of elastic type in order to ensure contact, however, the slide switch according to the invention has the possibility of failing in positive contact as both contact pieces, the detecting wheel (17) and the slide contact piece (24*b*) of the hour switch plate, are rigid.

In this embodiment, this problem is solved by providing three slide contact pieces (24*b*) and three corresponding second projections (17*b*) which are arranged to come in contact with each other almost at the same time. The provision of three second projections (17*b*) has the advantage to keep the hour wheel (12) in horizontal position. The hour switch plate (24) and the minute detecting wheel (16) are always in electric contact as the slide contact pieces (24*a*) are in sliding contact with the bottom face of the minute detecting wheel (16). An insulating plate (25) and an electric conductive sectoral switch plate (26) are placed on the minute detecting wheel (16) and fixed by means of caulking so that the minute detecting wheel (16) and the sectoral switch plate (26) are electrically connected.

The minute wheel (9), as described above, is made of electric conductive material and provided on its bottom face with three projections (9*d*). One of the projections (9*d*) is disposed so as to be able to come in contact with the sectoral switch plate (26) once every hour and the rest of the projections (9*d*) are disposed so as not to come in contact with the sectoral switch plate (26) at any time.

On the middle frame (2) there is fixed a second stationary contact plate (28), one elongation of which is in sliding contact with the upper face of the minute wheel (9) and the other elongation is connected to the positive terminal of the battery (E) so that the minute wheel (9) is always electrically connected with the positive terminal of the battery (E).

Following explanation is concerned with the performance of the switching mechanism.

The alarm signaling mechanism is set to generate alarm signal at an optional time by turning the knob (19) observing time indication by the alarm signaling time marks (20*c*) and (21*b*). The phases of the minute detecting wheel (16) and the hour detecting wheel (17), that is the phases of the sectoral switch plate (26) and the second projections (17*b*) of the hour detecting wheel (17), are determined according as the setting of the alarm signaling mechanism. The manual switch (SW) is turned on by the alarm signaling setting knob (23). At this moment the buzzer will not be actuated as electric circuit, the sectoral switch plate (26)—minute wheel (9) or the hour detecting wheel (17) - the hour switch plate (24), is not closed.

As time passes, the minute wheel (9) and the hour wheel (12) rotate once every hour and once every twelve hours, respectively.

The minute detecting wheel (6) and the hour detecting wheel (17) are urged to rotate by frictional force introduced by rotation of the minute wheel (16) and the hour wheel (17), respectively, however, both of them will be retained at the present phases as they are restrained by the minute alarm signaling time indicating wheel (20), which is restrained by the click-stop spring (29), through engagement with the third wheel (18*c*) and the second wheel (18*b*), respectively.

Although the minute wheel (9) comes in electric contact with the sectoral switch plate (26) once every hour, the buzzer (B) will not be actuated as the hour switch plate (24) has not come in electric contact with the hour detecting wheel (17) yet. As time passes, the phases of the slide contact pieces (24*b*) of the hour switch plate are synchronized with the phases of corresponding second projections (17*b*) of the hour detecting wheel for the first place and the hour switch plate and the hour detecting wheel are electrically connected.

The slide contact pieces (24*b*) are so designed as to maintain the contact between the slide contact pieces (24*b*) and the second projections (17*b*) for twenty to forty minutes during which the projections (9*d*) of the minute wheel comes in electric contact with the sectoral switch plate (26) so that the electric circuit, the first stationary contact plate (22)—the hour detecting wheel (17)—the hour switch plate (24)—the minute detecting wheel (16)—the sectoral switch plate (26)—the minute wheel (9)—the second stationary contact plate (28), is closed throughout to actuate the buzzer (B).

The buzzing can be stopped at any time by turning off the manual switch (SW). The buzzing is cut off automatically even when the manual switch (SW) is left turned on after a period of time corresponding to the length of the sectoral part of the sectoral switch plate (26).

Therefore, the period of buzzing time can be optionally determined by properly designing the length of the sectoral part of the sectoral switch plate (26).

Following explanation is concerned with time indication adjustment.

Rotation of the time indication adjusting wheel (14) by means of the knob (15) is transmitted to the minute wheel (9) and the hour wheel (12) through the intermediate hour wheel (11). Although the minute detecting wheel (16) and the hour detecting wheel (17) are urged to turn by frictional force provided by the minute wheel (9) and the hour wheel (12), they are restrained by the minute alarm signaling time indicating wheel (20) which is restrained by the click-stop spring (29). Rotation of the time indication adjusting wheel (14) is also transmitted to the intermediate spindle (7) through the minute wheel (9), however, the intermediate wheel (8) frictionally coupled with the intermediate spindle (7) by pressure provided by the leaf spring (32) is restrained independently of rotation of the intermediate spindle (7)

by the motor torque introduced through the second wheel (5) because the torque provided by the motor is greater than the frictional force between the intermediate spindle (7) and the intermediate wheel (8). Thus time indication can be adjusted by turning the knob (15) in either direction.

Referring now to FIG. 5, explanation will be made on the second embodiment of the invention.

A cover (103) and a printed circuit board (130) are fastened to a projection (102*a*) disposed at the left end of a middle frame (102) by means of screw (104). A gear train for the time indicating mechanism is constituted similarly to that of the first embodiment of a second wheel (105), an intermediate spindle comprising frictional coupling means and an intermediate wheel, not shown, a minute wheel (109), an intermediate hour wheel (111) and an hour wheel (112).

Following explanation is concerned with the gear train for the alarm signaling mechanism.

A second minute wheel (141) made of plastics rotates at a rotating rate equivalent to that of the minute wheel (109). A minute detecting wheel (125) made of electric conductive material is disposed between the second minute wheel (141) and the printed circuit board (130) and provided with three second projections (125*b*) on the upper face on different circles at equal angular intervals and three first projections (125*a*) on the bottom face on a circle at equal angular intervals similarly to the first embodiment.

An hour detecting wheel (117) is disposed between an hour wheel (112) and the printed circuit board (130) and fixedly provided with an index (132) at the end of its tubular boss (117*c*). An alarm signaling time setting spindle (118) comprises a first wheel (118*a*) and a second wheel (118*b*) and fixedly provided with an alarm signaling time setting knob (119) at an end. The first wheel (118*a*) is engaged with an idle wheel (134). The second wheel (118*b*) is engaged with the hour detecting wheel (117). The alarm signaling time setting spindle (118) is controlled by a fixed frictional force provided by a friction piece (133) fixed to the middle frame at one end and pressed against the upper face of the first wheel (118*a*).

Following explanation is concerned with the alarm signaling time detecting switch.

The printed circuit board (130) comprises a first pattern (130*a*) connected with one terminal of a buzzer (B) and a second pattern (130*b*) connected with the positive terminal of a battery (E).

The hour detecting wheel (117) made of electric conductive material is provided, similarly to that of the first embodiment, with three first projections (117*a*) and three second projections (117*b*) on its bottom and upper faces, respectively. The hour detecting wheel (117) and the first pattern (130*a*) are always electrically connected as the first projections (117*a*) are always in sliding contact with the first pattern (130*a*). An hour switch plate (124) having slide contact pieces (124*b*) extending downwardly similarly to that of the first embodiment is fixed on the hour wheel (112) made of plastics. The minute detecting wheel (125) and the second pattern (130*b*) are always electrically connected as the second projections (125*a*) is always in sliding contact with the second pattern wheel (141) made of plastics. The three projections (127*a*) come in contact with the second projections (125*b*) once every hour. The hour switch plate (124) and the minute switch plate (127) are always electrically connected as a first elongation (128*a*) and a second elongation (128*b*) of a stationary contact plate (128) are always in sliding contact with the upper faces of the hour switch plate (127), respectively.

Following explanation is concerned with performance of the alarm signaling mechanism.

In this embodiment, the alarm signaling mechanism is set to go off at an optional time by turning the alarm signaling time setting knob (119) observing indication of the index (132), while the minute detecting wheel (125) and the hour detecting wheel (117) are set at the phases corresponding to the alarm signaling time by the rotation of the alarm signaling time setting knob (119) transmitted to those detecting wheels through the 1st wheel (118*a*) and the 2nd wheel (118*b*) on the alarm signaling time setting spindle (118) and the idle wheel (134). Alarm signaling mechanism setting is completed by turning on the manual switch (SW).

Although the second projections (125*b*) of the minute detecting wheel and the projections (127*a*) of the minute switch plate come in electric contact once every hour, the buzzer will not be actuated until the hour detecting wheel (117) and the hour switch plate will have been electrically connected synchronously. As time passes, the phases of the second projections (117*b*) and the projections (124*b*) of the hour switch plate are synchronized for the first place so that the hour detecting wheel and the hour switch plate are electrically connected. While the electrical connection between the hour detecting wheel and the hour switch plate is maintained, the phases of the second projections (125*b*) of the minute detecting wheel and the projections (127*a*) of the minute switch plate come in synchronism so that the minute detecting wheel and the minute switch plate are electrically connected, thus when the electric circuit, the first pattern (130*a*)—the hour detecting wheel (117)—the hour switch plate (124)—the stationary contact plate (118)—the minute switch plate (127)—the minute detecting wheel (125)—the second pattern (130*b*), is closed all through, the buzzer (B) is actuated.

Explanation on the other performances will be omitted as they are quite identical with those of the first embodiment.

In the preferred embodiments described hereinbefore, the alarm signaling time is detected both at minute and hour place, however, in modifications, the function of the second minute wheel of the second embodiment may be substituted by the intermediate hour wheel having switching function or the alarm signaling time may be detected only at hour place omitting the detection at minute place.

Although in the preferred embodiments the projections, which are integral parts of the contact points of the detecting switches, are formed in spherical shape by a press machine, they may be prepared by welding material for contact point on the wheels or by bending material in raised shape by a press machine.

We claim:

1. In an alarm clock of the type having at least one rotationally driven rotatable time wheel, at least one rotatable detecting wheel rotatable relative to the time wheel to phases corresponding to alarm signaling times by an alarm signaling time setting wheel, and a time detecting switch having one switching state when the time wheel is out of phase with the detecting wheel and switchable to another switching state when the time wheel rotates into phase with the detecting wheel to thereby enable the sounding of an alarm at preselected alarm signaling times, the improvement wherein said time detecting switch comprises a slide switch comprising one of said time wheel and detecting wheel being comprised of a one-piece structure composed of electrically conductive material and having a gear teeth portion for meshing with another gear to effect rotational driving of the time wheel and further having a first set of projections which define the contact points of the slide switch, and the other of said time wheel and detecting wheel being at least partly composed of electrically insulating material and having a switch plate connected thereto having a contact portion for making sliding electrical contact with the first set of projections.

2. An alarm clock according to claim 4; wherein said time wheel is the one which comprises a one-piece structure composed of electrically conductive material, said time wheel having said gear teeth portion for meshing with another gear to effect rotational driving of the time wheel.

3. An alarm clock according to either of claims 1 or 2; wherein the first set of projections on the electrically conductive wheel comprise plural projections lying on circles of different radii and being angularly spaced-apart from one another a distance at least several times greater than the angular extent of the projections themselves.

4. An alarm clock according to claim 3; wherein the projections comprise indentations formed in the wheel.

5. An alarm clock according to claim 3; wherein the electrically conductive wheel has a second set of projections which project from the face of the wheel opposite the face from which project the first set of projections for providing continuous sliding electrical contact with circuitry for effecting the sounding of the alarm.

* * * * *